US005601405A

United States Patent [19]

Coates

[11] Patent Number: 5,601,405

[45] Date of Patent: Feb. 11, 1997

[54] VALVE APPARATUS FOR STEAM TURBINES

[76] Inventor: George J. Coates, 1811 Murray Dr., Wall Township, N.J. 07719

[21] Appl. No.: 514,589

[22] Filed: Aug. 14, 1995

[51] Int. Cl.[6] ..... F01D 9/02

[52] U.S. Cl. ..... 415/202; 137/625.47

[58] Field of Search ..... 415/202; 137/625.47, 137/625.32, 864

[56] References Cited

U.S. PATENT DOCUMENTS

| | | | |
|---|---|---|---|
| 3,372,906 | 3/1968 | Griffith | 415/202 |
| 4,003,403 | 1/1977 | Nehring | 415/625.47 |
| 4,097,188 | 6/1978 | Forster | 415/202 |
| 5,105,851 | 4/1992 | Fogelman | 137/625.47 |
| 5,125,797 | 6/1992 | Kapich | 415/202 |

*Primary Examiner*—John T. Kwon
*Attorney, Agent, or Firm*—Clifford G. Frayne

[57] ABSTRACT

A valve assembly for steam turbines having an intake valve of spherical section formed by two parallel planar sidewalls of a sphere disposed about the center thereof defining a spherical shaped end wall and formed with a shaft receiving aperture, the valve body formed with a plurality of apertures in a sidewall thereof, and a channel extending between each of the sidewall apertures with a corresponding aperture formed in the spherical shaped end wall, the intake valve rotatable independently about the shaft of the steam turbine for alignment with corresponding intake apertures in a circular steam chest disposed about the spherical shaped end wall of the intake valve.

10 Claims, 4 Drawing Sheets

VALVE APPARATUS FOR STEAM TURBINES

BACKGROUND OF THE INVENTION

1. Field of the Invention

The present invention relates to the field of steam turbines and, in particular, to the valve apparatus for introduction of steam into the turbine housing.

2. Description of the Prior Art

Steam turbines are normally divided into two (2) generally broad categories, those used for the generation of electric power and those used as general purpose units for driving pumps, compressors and the like. The horsepower output of the turbine is related to the revolutionary speed of the turbine which, in turn, is governed by the thermodynamic properties of the steam introduced into the turbine. Most turbo-electric generator drives operate at either 1800 or 3600 rpm. Inlet steam would usually be in the range of 250 lbs./sq. inch gauge at 0 super heat up to 850 lbs./sq. inch gauge at 900° F. Pressures of 1500, 1800, and 2400 lbs./sq. inch gauge are also common for large turbine generators and some even operate at super critical pressures of 3500 and 5000 lbs./sq. inch gauge.

The steam turbines normally operate as a single stage, single valve turbine wherein a single governor valve in a steam chest regulates the introduction of the steam into a single stage housing. A second type of steam turbine is a multi-stage single valve turbine in which, again, a single valve regulates the introduction of the steam into a turbine housing in which the turbine blades are arranged in a multi-stage arrangement. The third type of steam turbine is a multi-stage, multi-valve turbine wherein multiple valves regulate the introduction of the steam into the turbine housing wherein the turbine blades are positioned in a multi-stage arrangement.

In all of the above-identified instances, the steam is accumulated in a steam chest immediately prior to introduction into the turbine housing. The introduction is accomplished by means of the valve mechanism which in either the single or multi-valve arrangement normally consists of a poppet-type valve positioned intermediate to the turbine housing and a steam chest which when opened allows the introduction of steam into the turbine housing.

For optimum efficiency, the steam must be introduced at the desired time and under the desired parameters and directed with optimum efficiency on the turbine blades. The steam itself should be free of all solids. Unfortunately, this cannot always be accomplished. As such, certain inefficiencies develop in the steam turbine, one of which is the sticking of the valve stems due to a buildup on the stems of impurities contained in the steam. The sticking of the valve stems not only affects the efficiency of the steam turbine, but also, if gone undetected or uncorrected, can lead to mechanical damage to the turbine and down time and loss of power or use of the turbine.

Applicant has developed a spherical rotary valve system for use in internal combustion engines as evidenced in U.S. Pat. Nos. 4,944,261; 4,953,527; 4,976,232; 4,989,558; 4,989,576 and 5,109,814. Applicant has further refined this spherical rotary valve technology to replace the popper valve in a steam turbine with a spherical rotary valve which eliminates certain inefficiencies which develop with respect to a steam turbine utilizing a poppet valve for introduction of steam into the turbine chamber and further allows greater control of the timing, amount, and direction of steam to the turbine blades.

OBJECTS OF THE INVENTION

An object of the present invention is to provide for a novel valve apparatus for use with steam turbines for the introduction of steam into the turbine housing.

A still further object of the present invention is to provide for a novel valve apparatus for use with steam turbines for the introduction of steam into the turbine housing which permits greater efficiency with respect to the direction of the steam on the turbine blades.

A still further object of the present invention is to provide for a novel valve apparatus for a steam turbine for the introduction of steam into the turbine housing which permits greater control over the amount of steam introduced into the turbine housing.

A still further object of the present invention is to provide for a novel valve apparatus for a steam turbine which eliminates the buildup of impurities on the valve.

SUMMARY OF THE INVENTION

A spherical rotary valve for the replacement of poppet valves in a steam turbine, the spherical rotary valve positioned independently about the main shaft of the turbine, the spherical rotary valve having a plurality of openings on its spherical periphery in selective communication with a source of steam, the plurality of openings in the spherical periphery, in communication by means of internal passageways with a plurality of apertures on a planar sidewall of the spherical rotary valve to permit the passage of steam from the source of steam into the turbine housing, the passageways selectively designed to permit the aiming or targeting of the steam in a particular angle of direction into the turbine housing.

BRIEF DESCRIPTION OF THE DRAWINGS

These and other objects of the present invention will become evident particularly when considered with respect to the following drawings wherein.

DETAILED DESCRIPTION OF THE DRAWINGS

Figure 1:
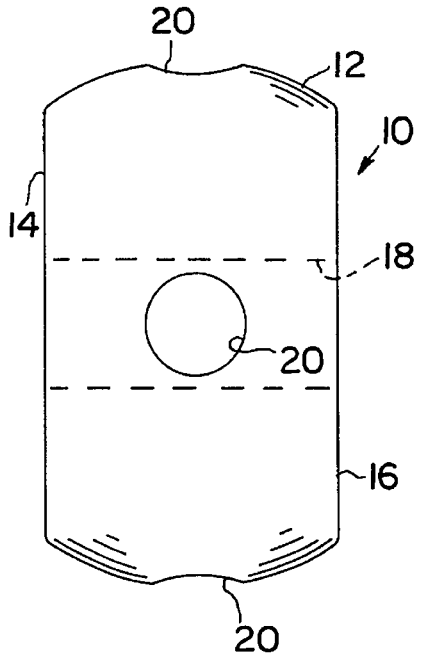
FIG. 1 is a side view of a spherical rotary valve for use with respect to a steam turbine.
Figure 3:
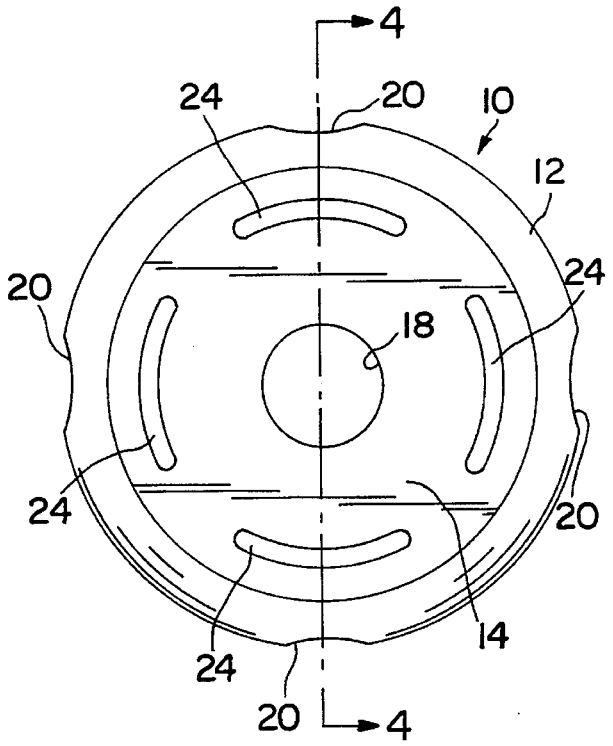
FIG. 3 is a front view of a spherical rotary valve for use with a steam turbine.
Figure 2:
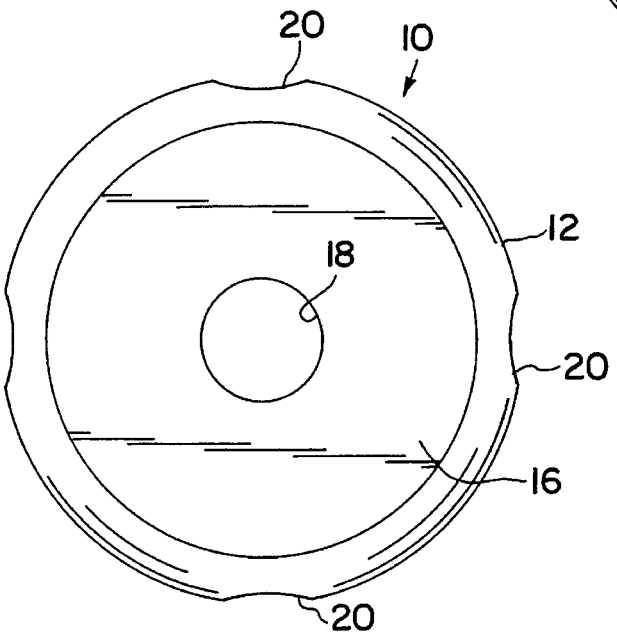
FIG. 2 is a rear view of a spherical rotary valve for use with a steam turbine.

Considering FIGS. 1, 2 and 3, there is shown a side, front and rear view of an intake valve 10 for use in a steam turbine. Intake valve 10 is defined by an arcuate spherical circumferential periphery 12 and planar sidewalls 14 and 16 in parallel relationship with each other. Centrally disposed on intake valve 10 is an axial throughbore 18 for the mounting of intake valve 10 as will be described hereafter and also to permit the passage therethrough of a turbine shaft on which will be mounted the turbine blades.

Figure 4:
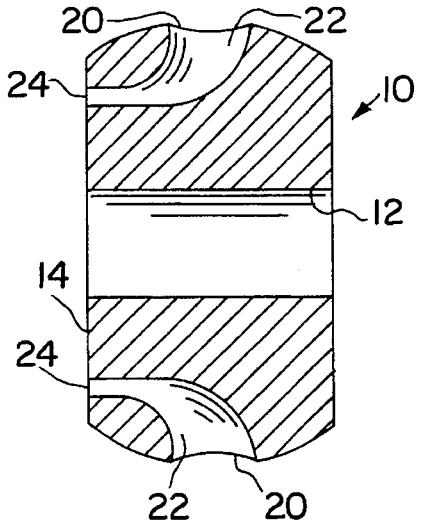
FIG. 4 is a cross-section side view of the spherical rotary valve along plane 4—4 of FIG. 3.

On spherical periphery 12 of intake valve 10 would be a plurality of apertures 20 which in this embodiment are shown to be circular, but in practice, may be elliptical or any other suitable shape. For purposes of this embodiment, this spherical periphery 12 is illustrated with four (4) apertures 20. Apertures 20 define the beginning of a passageway 22 as illustrated in FIG. 4, which is a cross-section along plane 4—4 of FIG. 3 which commences with aperture 20 and extends downwardly and then toward front face 14 terminating with an aperture 24. In this embodiment, aperture 24 on front face 14 of intake valve 10 is shown to be arcuate in shape. The shape of apertures 24 is such that they are designed to optimally direct or aim the steam in a preferred direction to the turbine blades. Therefore, while shown to be arcuate in shape in FIG. 3, in this embodiment, alternative shapes and angular positioning may be suitable depending upon the size and type of steam turbine in which intake valve 10 is installed.

Figure 5:
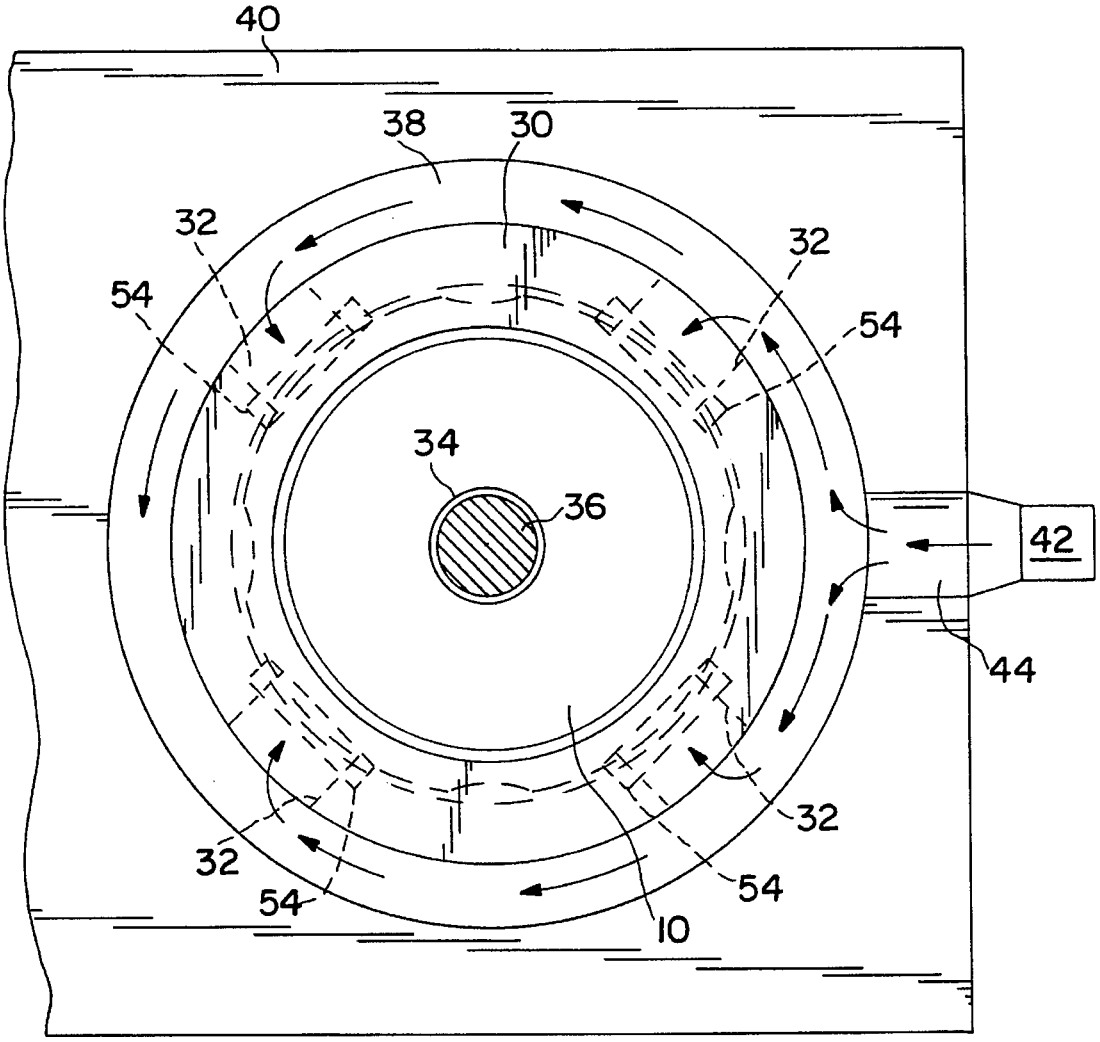
FIG. 5 is a front view of the spherical rotary valve within a casing.

FIG. 5 is a front view of intake valve 10 installed in a casing illustrating the manner in which intake valve 10 communicates with a steam source for directing the steam to the turbine blades. In FIG. 5, intake valve 10 is positioned within a casing 30 which has a plurality of apertures 32 on its periphery equal to the number of apertures 20 in the spherical periphery of intake valve 10. Intake valve 10 is mounted on a bearing means 34 which is independent of turbine shaft 36. Therefore, while the turbine shaft may rotate at several thousand rpm due to the introduction of steam against the turbine blades, the intake valve is stationary except when being rotated from an opened to closed postion. As will be explained hereafter, intake valve 10 can be rotated in a desired number of degrees to bring apertures 20 into alignment with apertures 32 in casing 30. Intake valve 10 can be rotated such that apertures 20 are in full alignment with apertures 32 in casing 30, partial alignment, or if desired, total non-alignment.

Apertures 32 are in communication with a ring chamber 38 enclosed and defined by a second casing 40. Ring chamber 38 is in communication with a steam source 42 by means of an intake conduit 44 which is in communication with ring chamber 38. Ring Chamber 38 serves as the steam chest in what would be a conventional steam turbine. Steam would circulate within ring chamber 38 awaiting release through apertures 32 and apertures 20 and thence into the turbine chamber.

In operation, steam from steam source 42 is introduced by means of conduit 44 into ring chamber 38 on a continuous basis. The rotation of intake valve 10, bringing apertures 20 into alignment with apertures 32 or even partial alignment, permits the steam from ring chamber 38 to pass through apertures 32 and 20 into passageway 22 within intake valve 10 and exit through apertures 24 on front face 14 of intake valve 10 and through expansion, engage and rotate the turbine blades and the turbine shaft.

It can be seen that there is no need for intake valve 10 to be fully rotatable about 360°. It is only necessary to rotate intake valve 10 to bring apertures 20 into either full or partial alignment with apertures 32 in first casing 30 to allow steam to enter the turbine chamber. Similarly, a slight rotation will effectively close aperture 32 and prevent the entry of steam into the turbine chamber.

The embodiment of the intake valve 10, as illustrated thus far, is shown with four apertures 20 on its spherical periphery 12 in communication with four arcuate openings 24 in face 14. Intake valve 10 could be designed with more or less openings in its spherical periphery in communication with an equal number of arcuate openings 24 in face 14. Additionally, the shape of apertures 24 in face 14 could be modified as a result of experimentation in order to improve efficiency. Still further, the apertures 24 in face 14 could be in communication with each other to form a concentric aperture for the introduction of steam into the turbine housing.

Figure 6:
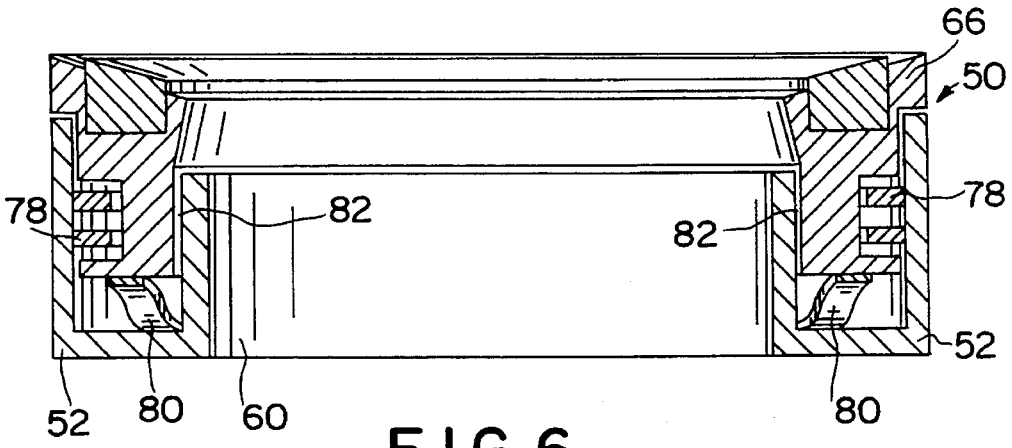
FIG. 6 is a cross-sectional view of a sealing means for the spherical rotary valve.

Each aperture 20 on the spherical periphery 12 of intake valve 10 would have associated with it, a sealing means cooperative with first casing 30 and positioned about aperture 32 in first casing 30 in order to form a seal between casing 30 and intake valve 10 to prevent the loss of steam. This sealing means is illustrated in FIGS. 6 and 7 which is a side cutaway view of the sealing means and a perspective exploded view of the sealing means, respectively.

Figure 7:
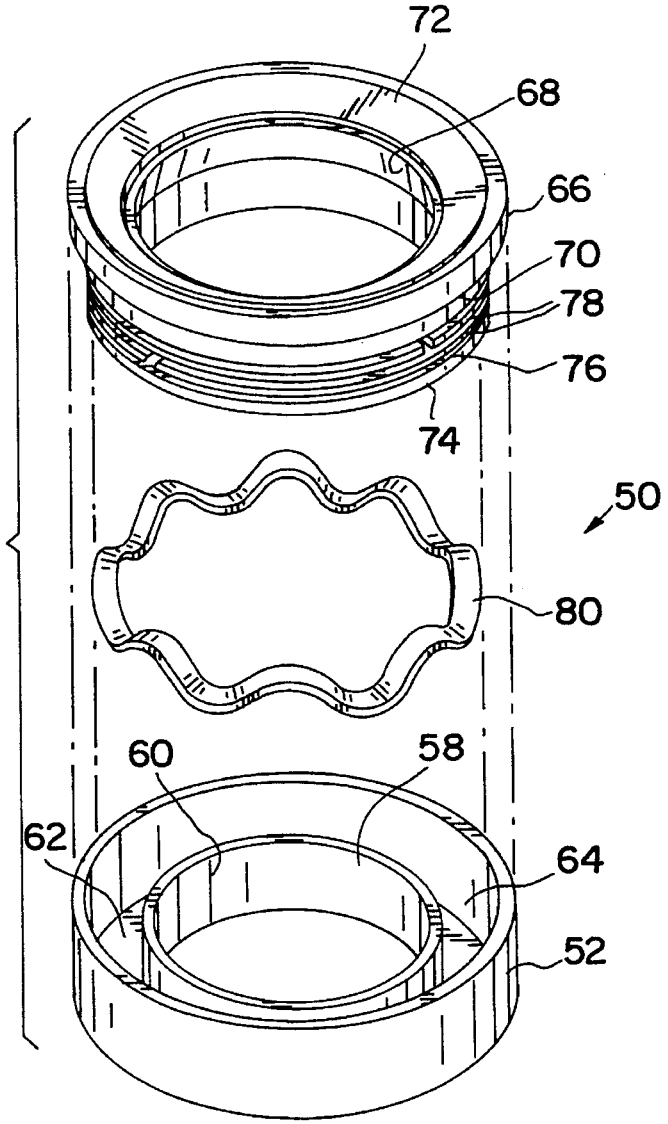
FIG. 7 is an exploded view of the sealing means for the spherical rotary valve.

Referring first to FIG. 7 inorder to identify the major components, the valve seal 50 is comprised of a lower receiving ring 52 configured to be received within an annular groove 54 in first casing 30, circumferentially positioned about apertures 32. Receiving ring 52 has an outer circumferential sidewall 56 and an inner circumferential sidewall 58 defining an aperture 60 which is coincidental with aperture 32. Inner circumferential wall 56 and outer circumferential wall 58 are secured by a planar circumferential base 62 thereby defining an annular receiving groove 64 for the receipt of the upper valve seal ring 66.

Upper valve seal ring 66 has a centrally-disposed aperture 68 in alignment with aperture 60 and lower receiving member 50. The outer wall 70 of upper valve seal member 66 is stepped inwardly from upper surface 72 to lower surface 74 in order to define an annular groove 76 for receipt of a blast ring 78 as defined hereafter. Upper valve seal ring 66 is designed to fit within annular groove 64 in lower valve seal receiving ring 52.

The upper surface 72 of valve seal ring 66 is curved inwardly towards the center of aperture 60. The curvature of upper surface 72 is such that it conforms to the spherical periphery curvature of the intake valve. Contact between valve seal ring 66 and the spherical curvature periphery of the intake valve is maintained by annular beveled springs 80 positioned in annular receiving groove 64 below valve seal ring 66. Annular beveled springs 80 maintain a pressure on valve seal ring 66 such that it contacts the spherical periphery of the intake valve maintaining a seal about apertures 20.

Additionally, blast ring 78 serves to provide additional sealing contact between valve seal ring 66 and the spherical periphery of the intake valve 10. Steam pressure from the steam source defines entry below blast ring 78 by means of annular gap 82. The pressurized steam provides pressure within annular groove 64 below blast ring 78 which serves to further provide a seal with the spherical periphery of the intake valve.

Figure 8:
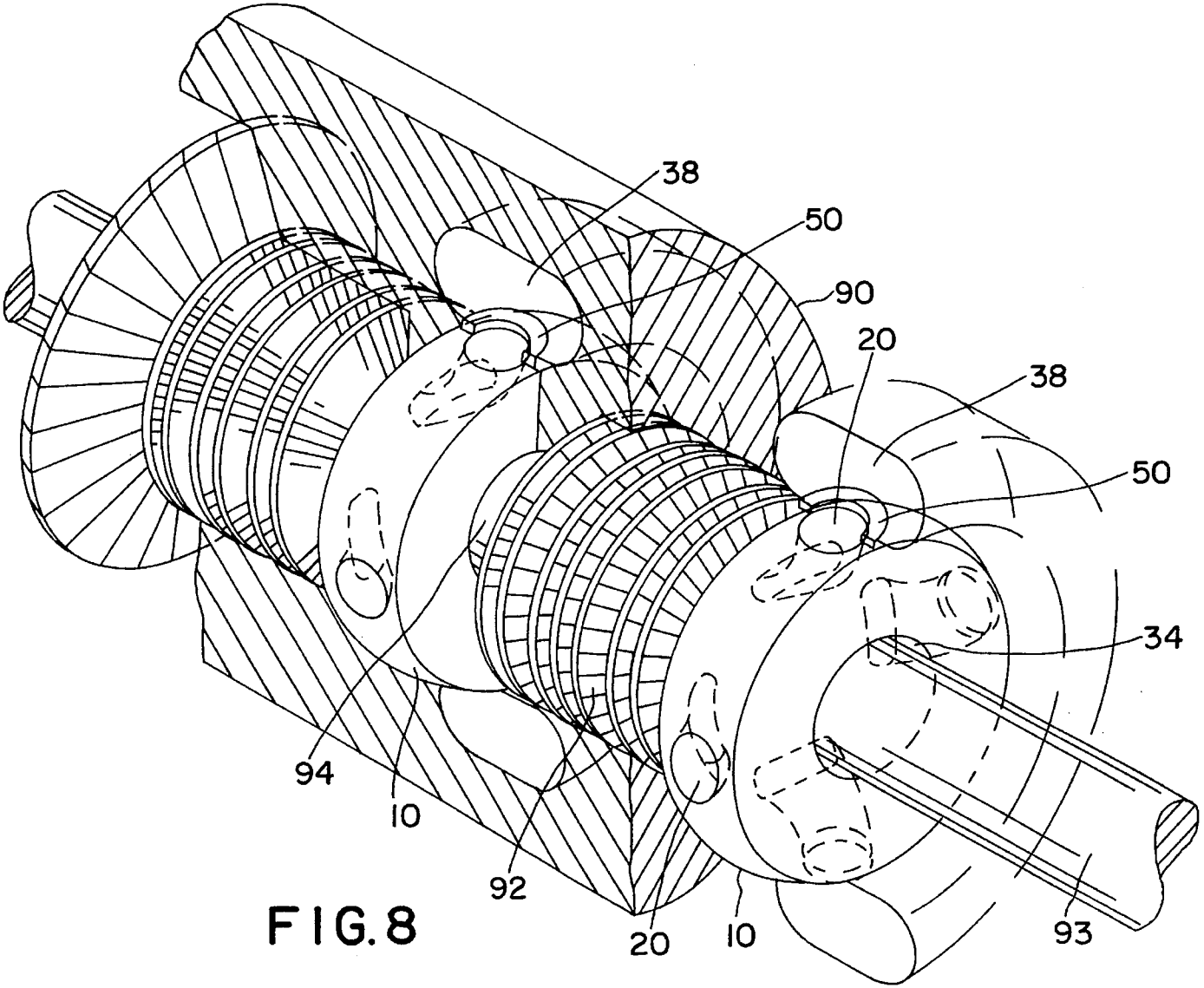
FIG. 8 is a partial cutaway view of a steam turbine showing the positioning of the spherical rotary valve.

FIG. 8 is a partial cutaway view of a turbine housing 90 illustrating the positioning of the intake valve 10 within the housing in relationship to ring chamber 38 and the turbine housing which houses the turbine blades 92 mounted on shaft 93. Intake valve 10 would normally have a thrust bearing assembly 94 positioned on its rear face 16 to absorb the rearward thrust generated by the steam being released through the apertures in front face 14.

As previously stated, intake valve 10 is required to rotate only a few degrees within casing 30 in order to align the apertures 20 in the spherical periphery with the apertures 32 in ring chamber 38. The means for rotating the intake valve 10 from a fully opened to a partially opened to a fully closed position may be accomplished with a worm gear assembly connected to a governing means which would automatically control the rotation of the intake valve dependent upon the speed of rotation of the turbine shaft or the pressure within the turbine housing itself. Governing means are well known in the art with respect to regulating the steam to the turbine housing and most often are responsive to turbine shaft rpm or pressure within the turbine housing. Worm gear assemblies are well known in the art as well as other assemblies which would permit the angular rotation of the intake valve 10 from an opened to a partially opened to a fully closed position. There would be no need to rotate the intake valve 10 360°, but rather to rotate it in one direction a few degrees to a fully opened position and then in a reverse direction the same number of degrees to a fully closed position.

The embodiment disclosed herewith has been primarily with respect to a single stage turbine; however, the valve assembly disclosed herein would be suitable and adaptable to multi-stage turbines.

Further, while the valve assembly has been referred to as an intake valve having a spherical periphery, mounted within a casing, the casing for mounting the intake valve may be integral with the housing of the turbine and not a separate casing or could in fact be a separate casing joined to the housing of the turbine.

While the present invention has been described in connection with the exemplary embodiment thereof, it will be understood that many modifications will be apparent to those of ordinary skill in the art and the application is intended to cover any adaptations or variations thereof. Therefore, it is manifestly intended that the invention be only limited by the claims and the equivalents thereof.

What is claimed:

1. A valve assembly for a steam turbine comprising:

a turbine housing having a centrally-disposed shaft therein, a plurality of turbine blades mounted on said shaft extending radially outwardly therefrom, a steam source for the introduction of steam into said housing, a valve assembly positioned in said housing for control of said introduction of said steam, said valve assembly comprising:

a valve having a drum body of spherical section formed by two parallel planar sidewalls of a sphere disposed about a center thereof thereby defining a spherically-shaped end wall and formed with a shaft receiving aperture, said drum body formed with a plurality of apertures in a sidewall thereof and a channel extending between each of said plurality of apertures in said sidewall with a corresponding aperture formed in said spherically-shaped end wall, said valve being positioned about said shaft of said turbine and rotatable independently of said shaft of said turbine a casing, defining a valve accommodating cavity, encapsulating said spherical end wall of said valve, said casing having an inner wall and outer wall defining a ring-like chamber about said spherical shaped end wall of said valve, said inner wall of said casing having a plurality of apertures alignable with said apertures on said spherical end wall of said valve, said ring-like chamber in communication with said steam source;

a sealing means positioned about said apertures in said inner wall of said casing and in communication with said spherical end wall of said valve for opening and closure of said plurality of apertures in said inner wall by rotation of said valve.

a means for rotation of said valve independently of said shaft of said turbine.

2. The valve assembly in accordance with claim 1 wherein said shaft receiving aperture in said intake valve is longitudinally formed on said center extending between said planar sidewalls.

3. The valve assembly in accordance with claim 1 wherein said channel extending between said apertures formed in said spherical shaped end wall of said intake valve and said apertures in said sidewall of said intake valve terminates at said sidewall, perpendicular to said sidewall.

4. The valve assembly in accordance with claim 1 wherein said channel extending between said apertures formed in said spherical shaped end wall of said intake valve and said apertures in said sidewall of said intake valve terminates non-perpendicular to said sidewall.

5. The valve assembly in accordance with claim 1 wherein said plurality of apertures in said sidewall of said intake valve are interconnected to form a concentric annular opening in said sidewall in communication with said apertures formed in said spherical shaped end wall.

6. The valve assembly in accordance with claim 1 wherein said sealing means for said intake valve comprises a receiving ring having defined therein an annular receiving groove, said receiving ring engageably secured in said inner wall of said casing, about each of said apertures in said inner wall of said casing, said receiving ring having an aperture therethrough coincidental with said apertures in said inner wall of said casing;

an upper ring removably securable within said annular receiving groove of said receiving ring, said upper ring having a curved upper surface conforming to said spherical shaped end wall of said valve, said upper ring having an aperture therethrough coincidental with said aperture of said receiving ring and said aperture in said inner wall of said casing;

a spring biasing means positioned in said annular receiving groove of said receiving ring, positioned below said upper ring and exerting upward pressure on said upper ring;

a sealing means positioned about said upper ring in contact with the outer wall of said annular receiving groove, said sealing means comprising a blast ring;

an annular communicating passageway between said receiving ring and said upper ring.

7. A method for controlling the introduction of steam into a steam turbine comprising:

a turbine housing having a centrally-disposed shaft therein, a plurality of turbine blades mounted on said shaft extending radially outwardly therefrom, a steam source for the introduction of steam into said housing, said method comprising:

positioning a valve having a drum body of spherical section formed by two parallel planar sidewalls of a sphere disclosed about a center thereof, thereby defining a spherical shaped end wall and formed with a shaft receiving aperture between said steam source and said turbine housing, said drum body formed with a plurality of apertures and a sidewall thereof and a channel extending between each of said plurality of apertures in said sidewall with a corresponding aperture formed in said spherical shaped end wall, said valve being positioned about said shaft of said turbine and rotatably independently from said shaft of said turbine;

encasing said valve in an accommodating cavity, encapsulating said spherical end wall of said valve;

forming a ring-like cavity in said casing, about said spherical shaped end wall of said valve;

forming a complimentary number of apertures in said casing for alignment with said apertures in said spherical shaped end walls so as to permit communication between said ring-like cavity and said valve;

positioning a sealing means in said casing, about said plurality of apertures in said casing, said sealing means positioned adjacent said spherical shaped end wall of said valve;

positioning a control means on said valve;

rotating said valve from an opened position in which said plurality of apertures in said spherical shaped end wall are in alignment with said apertures in said casing to a closed position in which said apertures in said spherical shaped end wall are in non-alignment with said apertures in said casing thereby controlling the introduction of steam into said turbine housing.

8. The method in accordance with claim 7 wherein said control means is responsive to the rotation of said turbine shaft.

9. The method in accordance with claim 7 wherein said control means is responsive to the steam pressure in said turbine housing.

10. An intake valve for a steam turbine which comprises:

a drum body of spherical section formed by two parallel planar sidewalls of a sphere disposed about a center thereof, thereby defining a spherical shaped end wall and formed with a shaft receiving aperture for a shaft, said shaft receiving aperture is longitudinally formed on said center extending between said planar sidewalls, said drum body rotatable independent of said shaft, said drum body formed with a plurality of exhaust apertures in one of said sidewalls thereof with a channel extending between said plurality of exhaust apertures in said sidewall to a plurality of corresponding intake apertures formed in said spherical shaped end wall, said channel between said plurality of intake apertures and said plurality of exhaust apertures intersecting said sidewall at a predetermined angle for directing said steam onto the blades of said steam turbine.

* * * * *